US012492635B2

(12) United States Patent
Yan et al.

(10) Patent No.: US 12,492,635 B2
(45) Date of Patent: Dec. 9, 2025

(54) SEGMENT WITH CONCRETE EMBEDDED WITH FLUID-FILLED STEEL PIPES

(71) Applicant: TONGJI UNIVERSITY, Shanghai (CN)

(72) Inventors: Zhiguo Yan, Shanghai (CN); Hehua Zhu, Shanghai (CN); Jiantao Li, Shanghai (CN); Yi Shen, Shanghai (CN); Tongsheng Yu, Shanghai (CN)

(73) Assignee: TONGJI UNIVERSITY, Shanghai (CN)

( * ) Notice: Subject to any disclaimer, the term of this patent is extended or adjusted under 35 U.S.C. 154(b) by 275 days.

(21) Appl. No.: 18/187,675

(22) Filed: Mar. 22, 2023

(65) Prior Publication Data

US 2023/0313681 A1 Oct. 5, 2023

(30) Foreign Application Priority Data

Mar. 29, 2022 (CN) ..... 202210326219.5

(51) Int. Cl.
*E21D 11/08* (2006.01)

(52) U.S. Cl.
CPC ..... *E21D 11/08* (2013.01)

(58) Field of Classification Search
CPC ..... E21D 11/08; E21D 11/04; E21D 11/00; E21D 5/00
See application file for complete search history.

(56) References Cited

U.S. PATENT DOCUMENTS 4,497,590 A * 2/1985 Chase ..... E21D 11/08 405/152
7,004,679 B2 * 2/2006 Naka ..... E21D 3/00 405/153

FOREIGN PATENT DOCUMENTS

| | | | |
|---|---|---|---|
| CN | 108222965 | * | 6/2018 |
| CN | 109869189 | * | 6/2019 |
| CN | 110500116 | * | 11/2019 |
| CN | 110593897 | | 12/2019 |
| CN | 110792453 | | 2/2020 |
| CN | 110939457 | | 3/2020 |
| CN | 111236971 | | 6/2020 |
| CN | 111305872 | | 6/2020 |
| CN | 112696211 | * | 4/2021 |
| CN | 112796798 | | 5/2021 |

(Continued)

*Primary Examiner* — Sean D Andrish
(74) *Attorney, Agent, or Firm* — JCIPRNET

(57) ABSTRACT

The present invention relates to an intelligent segment with concrete embedded with gas/liquid-filled steel pipes, the segment including a concrete portion, wherein the concrete portion serves as a main stress component of the segment, is made of ultra-high performance concrete and is provided with a hollow portion for arranging the steel pipes; a steel pipe portion, wherein the steel pipe portion includes the gas/liquid-filled steel pipes uniformly arranged on a tension side of the segment and penetrating through the entire segment in a circumferential direction, and a gas/liquid filling system and a pneumatic/hydraulic control system connected to the steel pipes; a reinforcing bar portion, wherein the reinforcing bar portion includes longitudinal bars for bearing the tension, stirrups for bearing the shear force and supports meeting construction structure requirements; and a joint portion, wherein the joint portion includes circumferential seam joints and longitudinal seam joints.

9 Claims, 9 Drawing Sheets

(56) References Cited

FOREIGN PATENT DOCUMENTS

| | | | |
|---|---|---|---|
| CN | 113944485 | * | 1/2022 |
| WO | WO 02/31317 | * | 4/2002 |

* cited by examiner

SEGMENT WITH CONCRETE EMBEDDED WITH FLUID-FILLED STEEL PIPES

CROSS-REFERENCE TO RELATED APPLICATION

This application claims the priority benefit of China application serial no. 202210326219.5, filed on Mar. 29, 2022. The entirety of the above-mentioned patent application is hereby incorporated by reference herein and made a part of this specification.

BACKGROUND

Technical Field

The present invention relates to the field of tunnel shield materials, in particular to an intelligent segment with concrete embedded with gas/liquid-filled steel pipes.

Description of Related Art

The shield technology is widely applied to underground traffic engineering, and shield linings often need to bear relatively high water and soil pressure and have relatively high requirements for impermeability. At present, especially for river bottom tunnels and deep-buried tunnels, the conventional shield lining forms can hardly meet the requirements of the engineering for both mechanical performances and working performances of structures, and methods such as large-area reinforcing ribs and secondary linings are required to improve the structure strength and reduce cracks; however, by means of such methods, the dead weight of the structures is increased, the construction processes are more complex, and the construction costs are increased to a certain extent.

SUMMARY

The present invention aims to provide an intelligent segment with concrete embedded with gas/liquid-filled steel pipes so as to overcome the defects in the prior art.

The purpose of the present invention can be achieved through the following technical solution:

the intelligent segment with the concrete embedded with the gas/liquid-filled steel pipes, the segment comprising:

a concrete portion, wherein the concrete portion serves as a main stress component of the segment, is made of ultra-high performance concrete and is provided with a hollow portion for arranging the steel pipes;

a steel pipe portion, wherein the steel pipe portion comprises the gas/liquid-filled steel pipes uniformly arranged on a tension side of the segment and penetrating through the entire segment in a circumferential direction, and a gas/liquid filling system and a pneumatic/hydraulic control system connected to the steel pipes;

a reinforcing bar portion, wherein the reinforcing bar portion comprises longitudinal bars for bearing the tension, stirrups for bearing the shear force and supports meeting construction structure requirements; and a joint portion, wherein the joint portion comprises circumferential seam joints and longitudinal seam joints, each of the circumferential seam joints comprises a circumferential seam hand hole and a high-strength inclined bolt, and each of the longitudinal seam joints comprises a steel plate connector, a longitudinal seam hand hole and a high-strength straight bolt.

The plurality of steel pipes are arranged, and rib marks are formed on the surfaces thereof and are used to meet the anchoring requirements between the steel pipes and the concrete.

Gas/liquid filling valves are arranged in steel pipe spans and are used to ensure uniform distribution of the initial stress in the steel pipes, the pneumatic/hydraulic control system comprises pneumatic/hydraulic monitoring devices and pressure stabilizing devices arranged at two ends of the steel pipes, the pneumatic/hydraulic monitoring devices are used to monitor the internal pressure of the gas/liquid-filled steel pipes in real time, when the internal pressure exceeds the preset internal pressure, gas/liquids in the steel pipes are released by means of the pressure stabilizing devices to maintain the pneumatic/hydraulic balance in the pipes, and the overall stress and deformation conditions of a tunnel structure are fed back according to the change of the gas/liquid pressure in the steel pipes.

The steel pipes are filled with phase-change materials which are used to adjust the temperature and prevent freezing in a tunnel.

The steel pipes are internally provided with support members for enhancing the rigidity of the steel pipes, and the support members are made of materials such as alloy steel, high polymers or high-polymer capsules.

The steel pipes are filled with the incomplete liquid which is used to absorb shocks and improve the shock resistance.

A shape memory alloy net is arranged on an inner surface of the intelligent segment, and deformation of shape memory alloys in different regions is controlled by means of electrified heating excitation so as to adjust the local mechanical performance of the segment.

Circumferential seams of the intelligent segment are connected by inserting the inclined bolts into the circumferential seam hand holes, the circumferential seam hand holes are uniformly formed in two sides of the circumferential seams in a staggered manner, and concave and convex mortises are uniformly formed at circumferential joints of the segment so as to facilitate construction, installation and positioning.

Longitudinal seams of the intelligent segment are connected to a circumferentially adjacent segment by matching the steel plate connectors and/or hand hole embedded members with the straight bolts installed in the longitudinal seam hand holes.

Each of the steel plate connectors is a complete straight steel plate, the straight steel plates of two circumferentially adjacent segments are fixedly connected by means of the straight bolts installed in the longitudinal seam hand holes, and two ends of the steel pipes in the segments are integrally welded to the steel plate connectors respectively; and the hand hole embedded members are arranged in the longitudinal seam hand holes, openings in sections of the hand hole embedded members face downwards, inner side surfaces of the hand hole embedded members are integrally welded to the two ends of the steel pipes, and outer side surfaces thereof are connected to the circumferentially adjacent segment by means of the straight bolts.

Compared with the prior art, the present invention has the following advantages:

I. compared with conventional segments, the segment of the present invention in the same size has the higher strength and can bear the higher water and soil pressure and the load during construction and operation;

II. compared with conventional segments, the segment of the present invention in the same size has the lower dead weight and is better in stress condition;

III. compared with conventional segments, the segment of the present invention in the same size has the higher rigidity and the more outstanding deformation resistance;

IV. the intelligent segment of the present invention has the better working performances such as the impermeability, the durability, the cracking resistance and the shock resistance, can be better adapted to shield construction and operation under complex working conditions, and meets the structure requirements of the shield linings;

V. the intelligent segment of the present invention is made of the high-performance concrete and is provided with the gas/liquid-filled steel pipes in a tension region, so that the reinforcement ratio in the tension region is reduced, and the costs are saved;

VI. the seam stress can be transferred to the whole segment structure by means of the longitudinal seam joint manner adopted by the intelligent segment of the present invention, so that the adverse effect of stress concentration of the seams is effectively reduced;

VII. parameters such as the number, the diameter, the thickness and the internal pressure of the steel pipes of the intelligent segment of the present invention can be adjusted according to the actual engineering requirements, so that the different engineering condition requirements can be flexibly met;

VIII. the concept of the intelligent segment of the present invention is beneficial to promotion of prefabricated development of underground construction;

IX. by means of the intelligent segment of the present invention, the use amount of the concrete is reduced, which is beneficial to promotion of low carbon and environmental protection; and X. according to the intelligent segment of the present invention, the local mechanical performance of the segment can be adjusted by means of the memory alloy net, so that the segment can effectively cope with the complex load changes of the underground structure under different working conditions and meet the different engineering requirements.

BRIEF DESCRIPTION OF THE DRAWINGS

FIGS. 2A to 2G show the steel pipe layout of solution I in the embodiment, wherein FIG. 2A shows the layout of gas/liquid-filled steel pipes, FIG. 2B is a section view of an I-I side of FIG. 2A, FIG. 2C to 2F are detail views of gas/liquid filling valves, and FIG. 2G is a left view of FIG. 2A.

FIGS. 3A to 3G show the steel pipe layout of solution II in the embodiment, wherein FIG. 3A shows the layout of gas/liquid-filled steel pipes, FIG. 3B is a section view of an II-II side of FIG. 3A, FIG. 3C to 3F are detail views of gas/liquid filling valves, and FIG. 3D is a left view of FIG. 3A.

FIGS. 4A to 4G are structure diagrams of seams of the present invention, wherein FIG. 4A is a structure diagram of a longitudinal joint of solution I, FIG. 4B is a structure diagram of a longitudinal joint of solution II, FIG. 4C is a structure diagram of a circumferential joint, FIG. 4D is a structure diagram of a longitudinal seam, FIG. 4E is a structure diagram of a circumferential seam without a mortise, FIG. 4E is a structure diagram of a circumferential seam with a mortise, FIG. 4G is a detail view of a circumferential seam concave mortise.

DESCRIPTION OF THE EMBODIMENTS

The present invention is described in detail in conjunction with the accompanying drawings and particular embodiments below.

The present invention provides an intelligent segment with concrete embedded with gas/liquid-filled steel pipes, which is described in detail below.

1. Composition

Figure 1A:
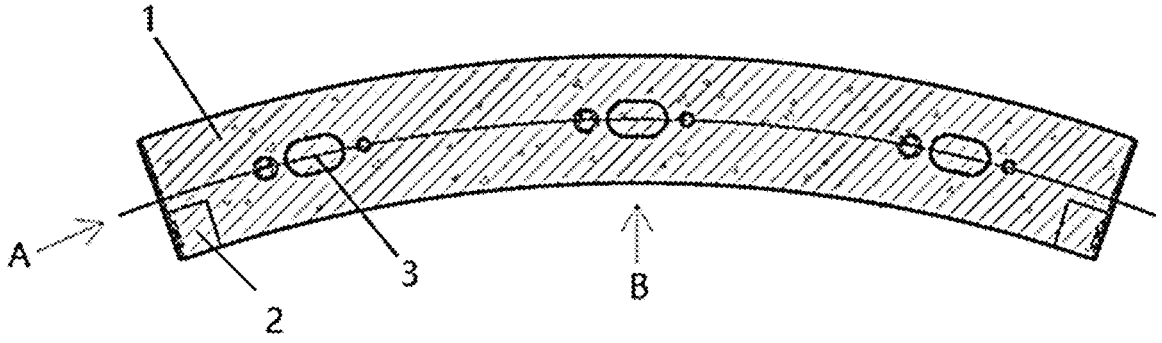
FIG. 1A is a main section view of an intelligent segment of the present invention.
Figure 1B:
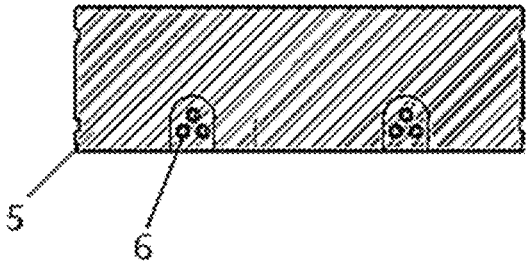
FIG. 1B is an A-direction view of FIG. 1A.
Figure 1C:
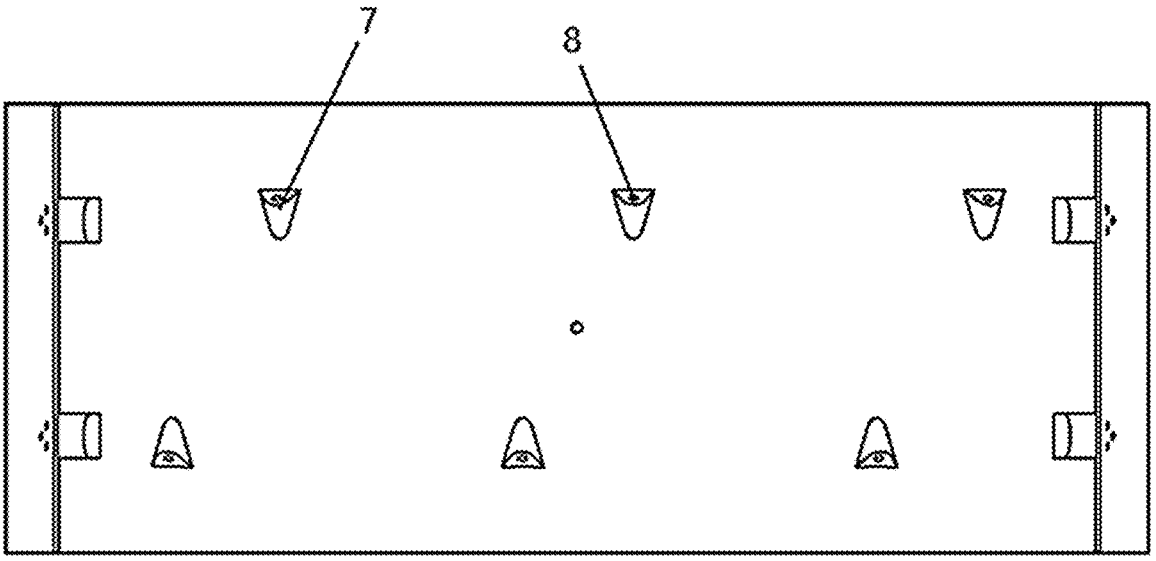
FIG. 1C is a B-direction view of FIG. 1A.
Figure 1D:
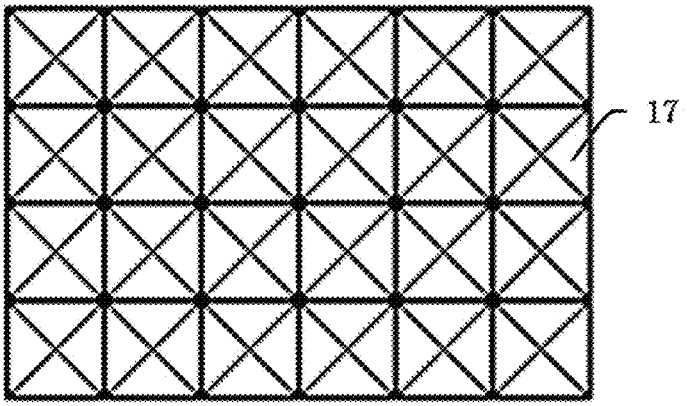
FIG. 1D is a structure diagram of rectangular and triangular memory alloy nets.
Figure 2A:
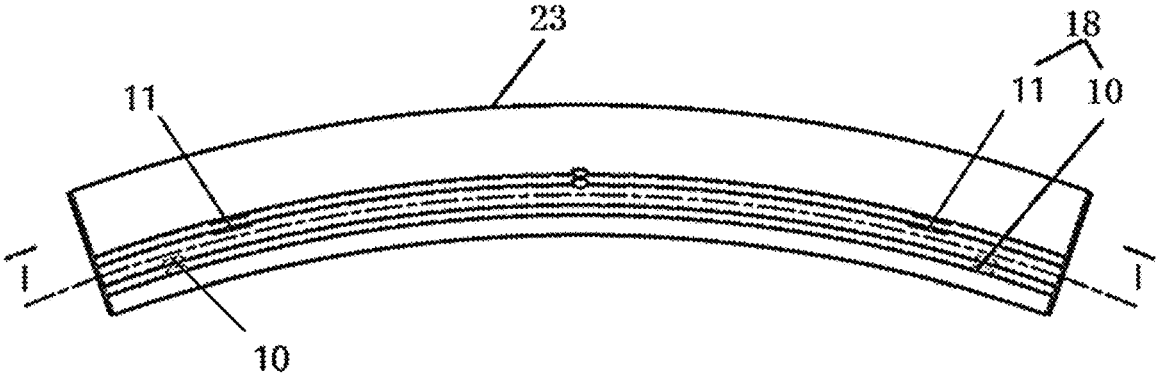
Figure 2B:
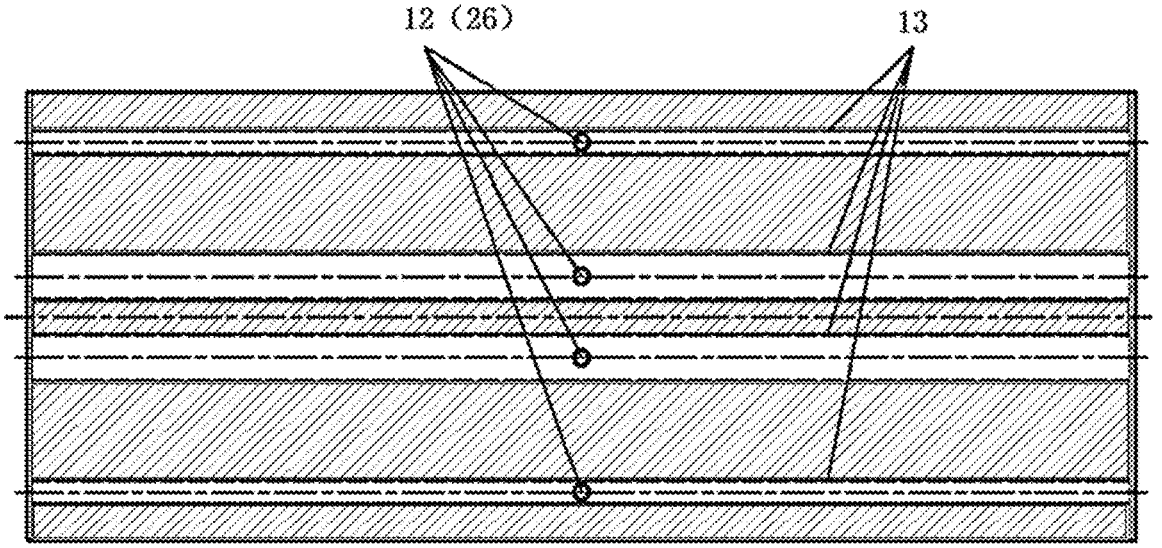
Figure 2C:
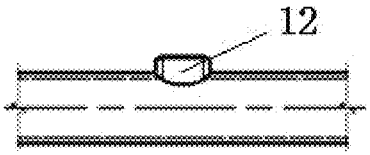
Figure 2D:
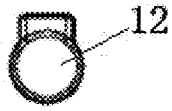
Figure 2E:
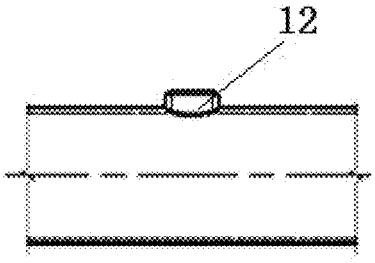
Figure 2F:
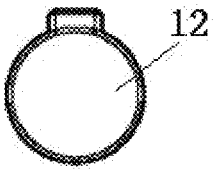
Figure 2G:
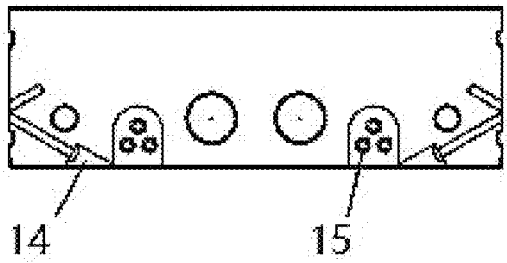
Figure 3A:
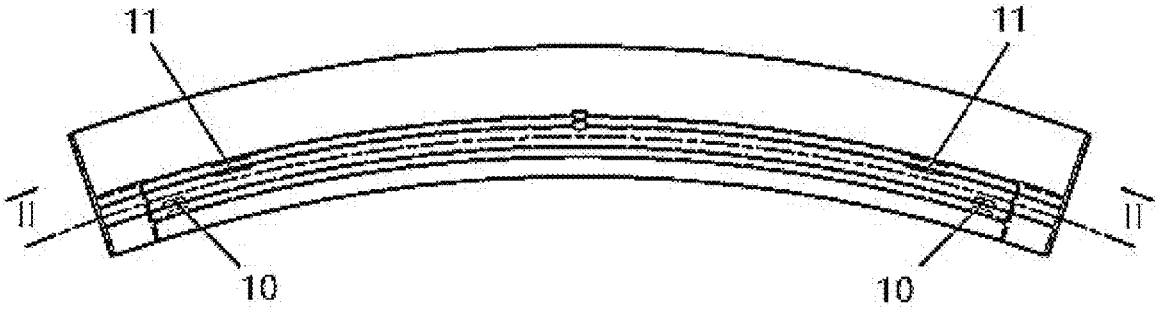
Figure 3B:
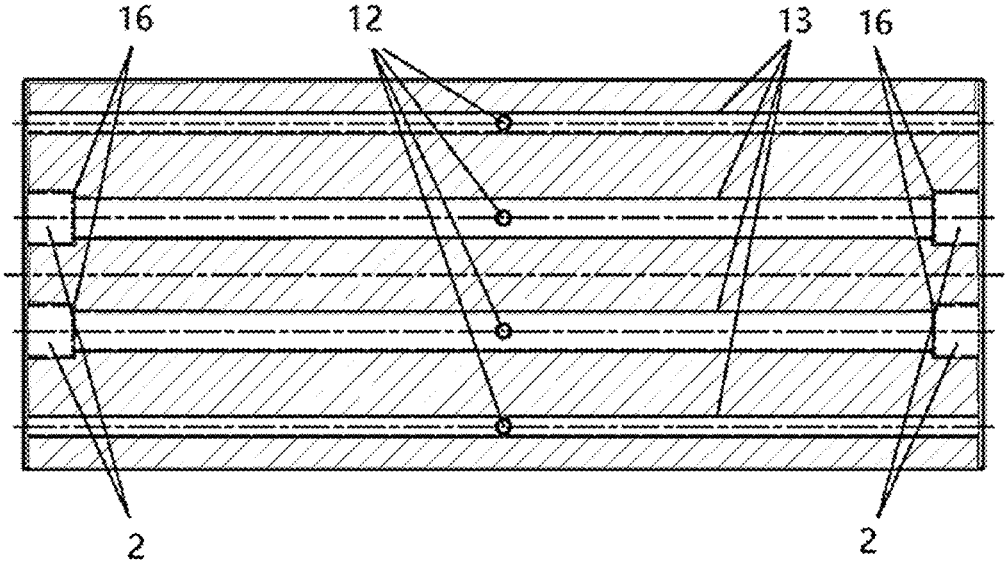
Figure 3C:
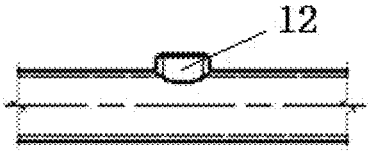
Figure 3D:
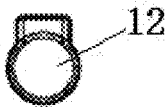
Figure 3E:
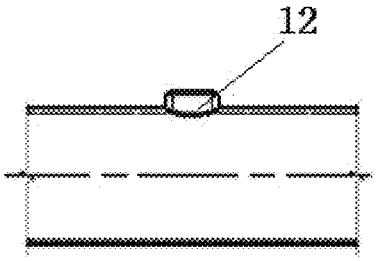
Figure 3F:
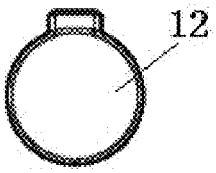
Figure 3G:
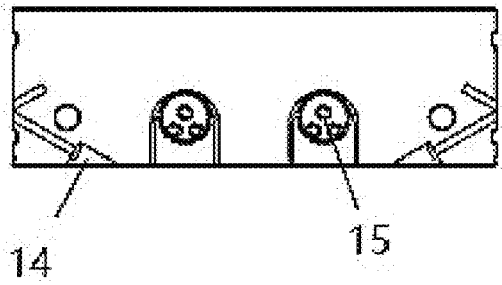
Figure 4A:
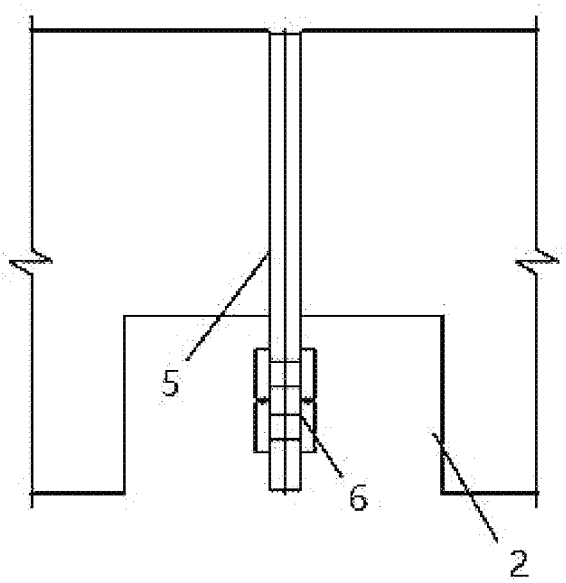
Figure 4B:
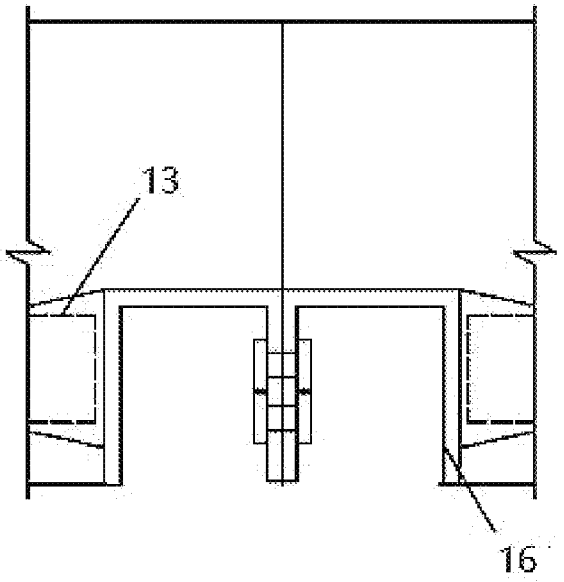
Figure 4C:
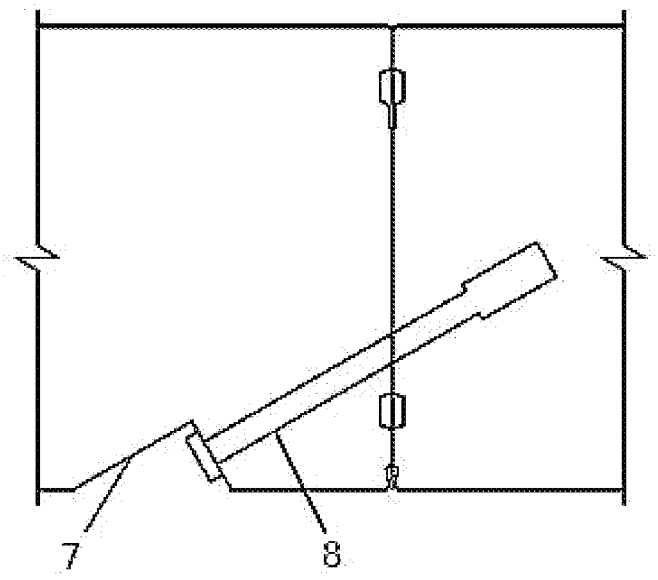
Figure 4D:
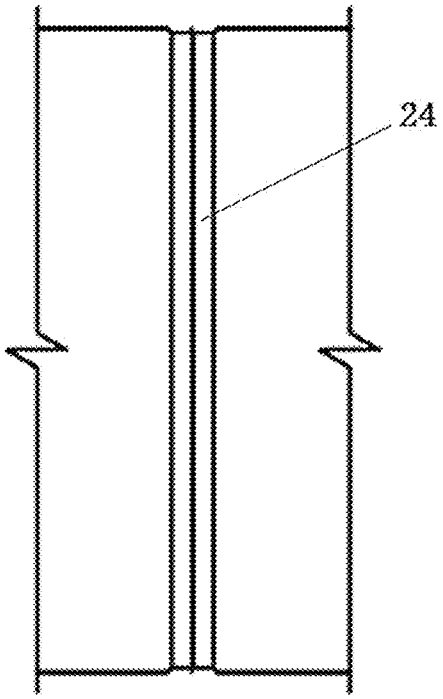
Figure 4E:
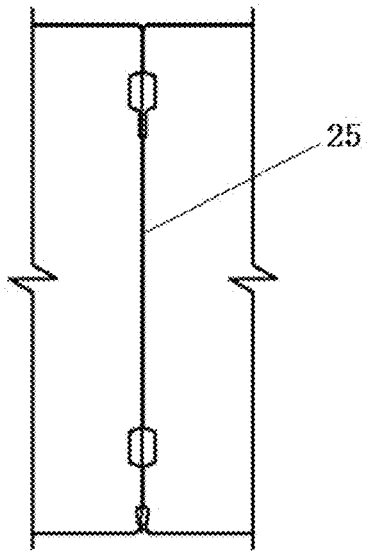
Figure 4F:
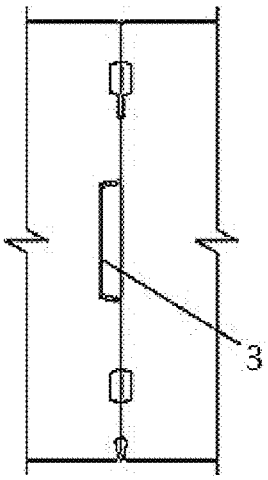
Figure 4G:
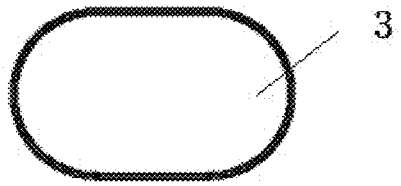

The segment of the present invention structurally comprises a concrete portion 1, a steel pipe portion, a reinforcing bar portion 22, a joint portion and a controllable deformation material portion, wherein the concrete portion 1 is made of common, high-strength or ultra-high performance concrete; the steel pipe portion is made of a 20CrMo material and comprises a gas/liquid filling system 26 and a pneumatic/hydraulic control system 18; the reinforcing bar portion 22 is made of reinforcing bars in the model of HRB400; the joint portion comprises circumferential seam joints 14 and longitudinal seam joints 15, each of the circumferential seam joints 14 comprises a circumferential seam hand hole 7 and a high-strength inclined bolt 8, and each of the longitudinal seam joints 15 comprises a Q345 steel plate connector 5 and a high-strength straight bolt 6; and the controllable deformation material portion is a shape memory alloy net 17, is made of an NiTi alloy, is installed on a surface as shown in FIG. 1C, and may be honeycombed, triangular or rectangular (as shown in FIG. 1D). See Table 1 for details.

Table 1 Components of Segment and Functions

TABLE 1

Components of Segment and Functions

| Composition | Component | Function | Remarks |
|---|---|---|---|
| Concrete portion | Concrete segment | Main stress component | Use ultra-high performance concrete, and provide a hollow portion for steel pipes |
| Steel pipe portion | Steel pipes | Main stress components | Use 20CrMo steel pipes |
| | Gas/liquid filling valves 12 | Supply high-pressure gas or liquid | Located in steel pipe spans |
| | Gas/liquid pressure sensors 10 | Monitor internal gas/liquid pressure in steel pipes | Located at two ends of the steel pipes |
| | Pressure stabilizing devices 11 | Stabilize the internal gas/liquid pressure in the steel pipes | Located at two ends of the steel pipes |
| Reinforcing bar portion 22 | Longitudinal bars | Mainly bear tension | Use reinforcing bars in the model of HRB400 |
| | Stirrups 19 | Mainly bear shear force | Use reinforcing bars in the model of HRB400 |
| | Supports 20 | Meet construction structure requirements | Use reinforcing bars in the model of HRB400 |
| Joint portion | Hand holes | Facilitate joint construction | Inclined hand holes for circumferential seams 25, and straight hand |

TABLE 1-continued

| Components of Segment and Functions | | | |
|---|---|---|---|
| Composition | Component | Function | Remarks |
| | | | holes for longitudinal seams 24 |
| | High-strength bolts | Bear joint stress | Inclined bolts 8 for circumferential seams, 25, and straight bolts 6 for longitudinal seams 24 |
| | Steel plates | For longitudinal seam connectors | Use steel plates in the model of Q345, welded to the gas/liquid-filled steel pipes 13 |
| | Mortises | For circumferential positioning | form concave and convex mortises 3 on two sides of the circumferential seams 25 respectively and correspondingly |
| Controllable deformation material portion | Shape memory alloy net 17 | For local stress adjustment and deformation control | Use an NiTi alloy, and installed on an inner surface of the segment |

2. Steel Pipe Design Principle

For the steel pipe design, the mechanical requirements of the structure should be considered firstly, and then the structure requirements of the structure should be considered. According to the stress conditions of the structure, the gas/liquid-filled steel pipes 13 should be uniformly arranged on the tension side, and it can be known from experiments that the rigidity of the segment is positively related to the number, the diameter, the internal pressure and the thickness of the steel pipes and the dead weight of the segment is negatively related to the number and the diameter of the steel pipes. Attention should be paid to the local stress safety of the concrete around the steel pipes during the steel pipe design. According to the structure requirements of the structure, the steel pipes penetrate through the whole segment in the circumferential direction, and collisions with the circumferential seam joints 14 need to be avoided. Rib marks 23 are designed on outer surfaces of the steel pipes so as to meet the anchoring requirements between the steel pipes and the concrete.

The gas/liquid filling valves 12 are arranged in the steel pipe spans, which is beneficial to uniform distribution of the initial stress in the steel pipes. The pneumatic/hydraulic control system 18 is arranged at the two ends of the steel pipes and comprises the pneumatic/hydraulic monitoring devices and the pressure stabilizing devices 11. The pneumatic/hydraulic monitoring devices can monitor the internal gas pressure of the gas/liquid-filled steel pipes 13 in real time, which facilitates safety evaluation. Once the gas/liquid pressure exceeds the preset internal pressure, the pressure stabilizing devices 11 can release the gas/liquids to maintain the pneumatic/hydraulic balance in the pipes.

The steel pipes can be filled with the gas or liquids and can also be filled with phase-change materials which are used to adjust the temperature and prevent freezing in a tunnel.

Support members can be properly arranged in the steel pipes to improve the rigidity of the steel pipes, can be made of alloy steel as well as high polymers or high-polymer capsules, and have the better working performances under the equivalent mechanical performance conditions.

According to the need for shock resistance, the steel pipes can be filled with a certain amount of liquid (not full) which is used to absorb shocks and improve the shock resistance.

The pneumatic/hydraulic monitoring devices on the steel pipes can feed back the overall stress and deformation conditions of a tunnel structure according to the change of the gas/liquid pressure in the steel pipes.

The steel pipes of various segments can be connected by means of pipelines to realize distribution of the gas/liquid among the different segments, and can also be supplemented with pressure from the outside to realize automatic adjustment of the overall rigidity, deformation and stress of the tunnel structure.

According to disaster warnings such as earthquake warnings, the pressure in each steel pipe of the segment can be adjusted in advance to change the stress state of a whole-ring structure, thereby improving the disaster resistance when disasters come.

3. Joint Design Principle

Novel segment joint designs are divided into the longitudinal seam joints 15 and the circumferential seam joints 14. The circumferential seams 25 are connected by inserting the inclined bolts 8 into the hand holes, and the circumferential seam hand holes 7 are uniformly formed in two sides of the circumferential seams 25 in a staggered manner. The steel plate connectors 5 are arranged at the longitudinal seams 24, the steel plate connectors 5 and the gas/liquid-filled steel pipes 13 in the segment are integrally welded, and the straight bolts 6 are installed in the longitudinal seam hand holes 2 to be connected to the circumferentially adjacent segment. The circumferential stress at the longitudinal seams 24 can be diffused to the whole segment by means of the gas/liquid-filled steel pipes 13, which is beneficial to reduction of the stress concentration effect at the joints of the segment. Hand hole embedded members 16 are arranged at the longitudinal seams 24, so that the longitudinal seams 24 of the intelligent segment are connected to the circumferentially adjacent segment by matching the hand hole embedded members with the straight bolts 6 installed in the longitudinal seam hand holes 2.

The concave and convex mortises 3 are uniformly formed at the circumferential joints of the segment so as to facilitate construction, installation and positioning. The seams of the segment are subjected to the seam water stop design according to standards so as to improve the impermeability of the structure.

4. Controllable Deformation Material Design Principle

The controllable deformation material portion is a shape memory alloy net made of the NiTi alloy and is installed on the inner surface of the segment by means of the reliable adhesive, the shape memory alloy net is communicated with a circuit, and shape memory alloys in different regions can be heated by means of the current so as to control local deformation of the segment and adjust the local stress of the concrete.

Embodiment

Taking a shield tunnel across the Yangtze River as an example, a segment of the tunnel has an inner diameter of 14.1 m, an outer diameter of 15.4 m, a wall thickness of 650 mm and a ring width of 2 m. The form of a composite segment with ultra-high performance concrete embedded with gas-filled steel pipes is adopted, four hollow steel pipes having the thickness of 8 mm are arranged in the segment, wherein the two steel pipes in the middle have the diameter of 200 mm and the circle center distance of 360 mm, the two steel pipes on the outer side have the diameter of 100 mm and the circle center distance of 1560 mm, and high-pressure gas under 3 MPa is introduced into all the steel pipes.

According to numerical simulation of finite element software, compared with existing concrete shield segments, the composite segment with the ultra-high performance concrete embedded with the gas-filled steel pipes has the advantages that the dead weight is reduced by about 10%, and the rigidity is improved by about 30%, thereby effectively improving the stress performance of the segment in the shield tunnel. Steel plate connectors are used at circumferential joints of the segment and are welded to the gas-filled steel pipes, so that the stress of bolts at the junctions can be reduced, meanwhile, the stress at the junctions is diffused by means of the steel pipes to the steel plates and the concrete in contact with the steel pipes to be borne jointly, and the condition of stress concentration at the joints is greatly improved.

According to engineering geological investigations, typical sections DK14 and DK211 are selected, the structural design is finally completed by calculating loads and analyzing internal forces, and the results are as shown in Table 2.

TABLE 2

| Design Result | | | | | |
|---|---|---|---|---|---|
| Section | position | Longitudinal bar | Calculated area ($mm^2$) | Actual area ($mm^2$) | Stirrup |
| DK14 | Inner side | 4φ32 | 5536 | 3217 | φ10@200 |
| | Outer side | 8φ32 | 5536 | 6434 | |
| DK211 | Inner side | 20φ32 | 22338 | 16085 | φ10@150 |
| | Outer side | 28φ32 | 22338 | 22518 | |

Figure 5:
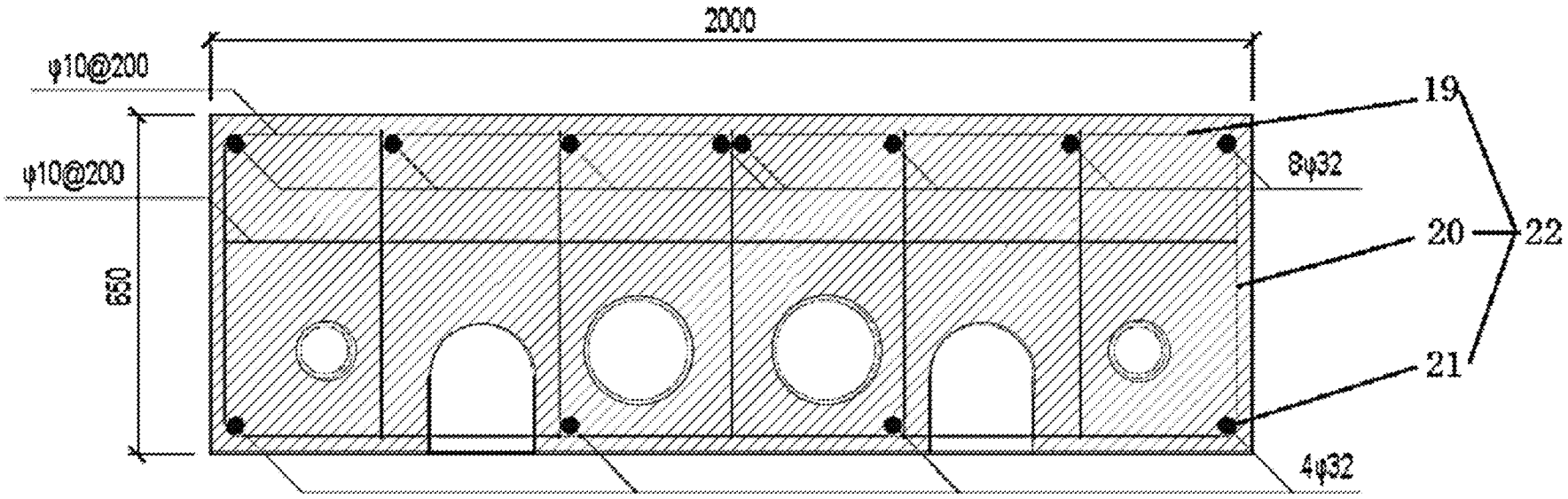
FIG. 5 is a section view of a DK14 segment.
Figure 6:
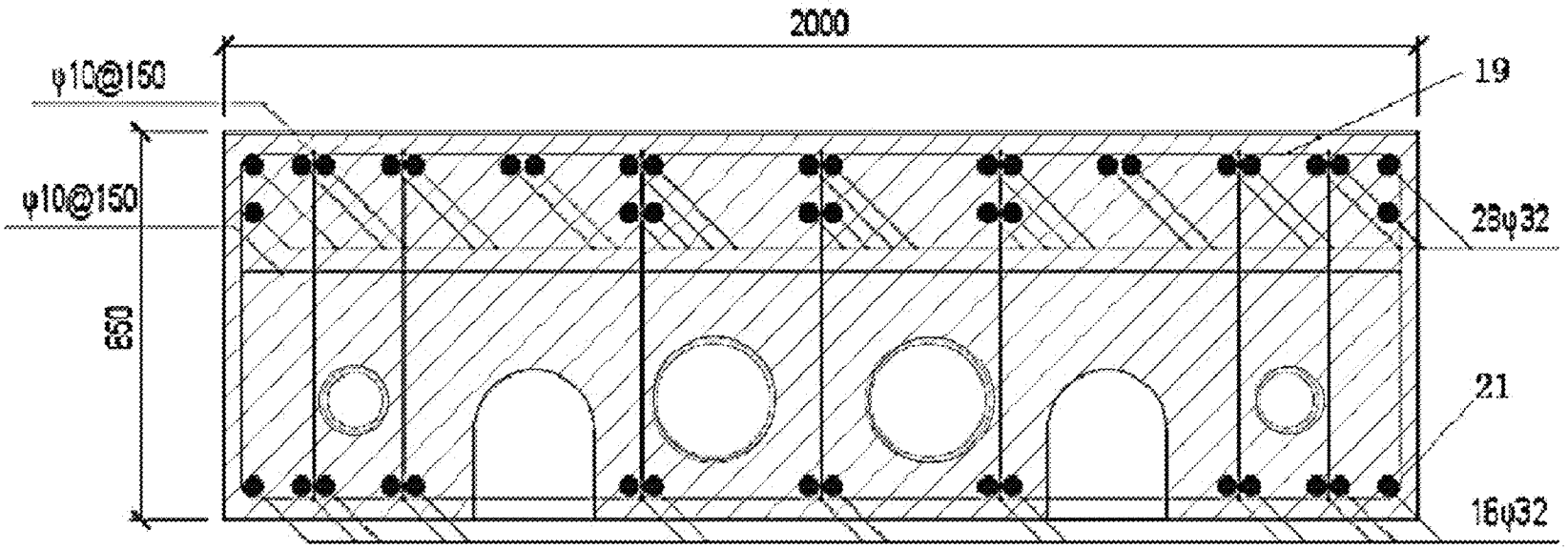
FIG. 6 is a section view of a DK211 segment.

The DK14 segment section is as shown in FIG. 5, and the DK211 segment section is as shown in FIG. 6.

In conclusion, in order to meet the structure requirements of river bottom tunnels or deep-buried tunnels for shield linings, an ultra-high performance concrete material is used, the intelligent segment with the concrete embedded with the gas/liquid-filled steel pipes is designed, the segment improves the rigidity and the strength of the structure, greatly reduces reinforcing bars required by the segment and effectively reduces the stress concentration effect at the joints while effectively reducing the dead weight of the structure, and the working performances such as the durability, the impermeability and the shock resistance are superior to those of conventional segments. In addition, the segment also conforms to the development trend of prefabricated structures of underground tunnels, can greatly reduce the use amount of the concrete, and can meet the requirements of the national low-carbon strategy.

What is claimed is:

1. A segment with concrete embedded with fluid-filled steel pipes, the segment comprising:

a concrete portion, wherein the concrete portion serves as a main stress component of the segment, is made of ultra-high performance concrete and is provided with a hollow portion for arranging the fluid-filled steel pipes;

a steel pipe portion, wherein the steel pipe portion comprises the fluid-filled steel pipes uniformly arranged on a tension side of the segment and penetrating through the entire segment in a circumferential direction, and a fluid filling system and a pressure control system connected to the fluid-filled steel pipes;

a reinforcing bar portion, wherein the reinforcing bar portion comprises longitudinal bars for bearing a tension, stirrups for bearing a shear force and supports; and a joint portion, wherein the joint portion comprises circumferential seam joints and longitudinal seam joints, each of the circumferential seam joints comprises a circumferential seam hand hole and an inclined bolt, and each of the longitudinal seam joints comprises a steel plate connector, a longitudinal seam hand hole and a straight bolt, wherein fluid filling valves are arranged in steel pipe spans and are used to ensure uniform distribution of an initial stress in the fluid-filled steel pipes, the pressure control system comprises pressure monitoring devices and pressure stabilizing devices are arranged at two ends of the fluid-filled steel pipes, the pressure monitoring devices are used to monitor an internal pressure of the fluid-filled steel pipes in real time, wherein when an internal pressure exceeds a preset internal pressure, fluids in the fluid-filled steel pipes are released by the pressure stabilizing devices to maintain a pressure balance in the fluid-filled steel pipes, and an overall stress and deformation conditions of a tunnel structure are fed back according to a change of a fluid pressure in the fluid-filled steel pipes.

2. The segment according to claim 1, wherein the plurality of fluid-filled steel pipes are arranged, and rib marks are formed on outer surfaces thereof and are configured to enhance anchoring between the fluid-filled steel pipes and the concrete.

3. The segment according to claim 1, wherein the fluids in the fluid-filled steel pipes comprises phase-change materials which are used to adjust a temperature and prevent freezing in a tunnel.

4. The segment according to claim 1, wherein the fluid-filled steel pipes are internally provided with support members for enhancing a rigidity of the fluid-filled steel pipes, and materials of the support members comprising alloy steel, high polymers or high-polymer capsules.

5. The segment according to claim 1, wherein the fluid-filled steel pipes are partially filled with a liquid which is used to absorb shocks and improve a shock resistance.

6. The segment according to claim 1, wherein a shape memory alloy net is arranged on an inner surface of the segment, and deformation of shape memory alloys in different regions is controlled by means of electrified heating excitation so as to adjust a local mechanical performance of the segment.

7. The segment according to claim 1, wherein circumferential seams of the segment are connected by inserting inclined bolts into the circumferential seam hand holes, the circumferential seam hand hole is formed in two sides of the circumferential seams in a staggered manner, and concave and convex mortises are uniformly formed at circumferential joints of the segment.

8. The segment according to claim 1, wherein longitudinal seams of the segment are connected to a circumferentially adjacent segment by matching steel plate connectors and/or hand hole embedded members with straight bolts installed in the longitudinal seam hand hole.

9. An assembly of segments according to claim 8, wherein each of the steel plate connectors is a complete straight steel plate, the complete straight steel plates of two circumferentially adjacent segments are fixedly connected by means of the straight bolts installed in the longitudinal seam hand hole, and two ends of the fluid-filled steel pipes in the segments are integrally welded to the steel plate connectors respectively; and the hand hole embedded members are arranged in the longitudinal seam hand hole, openings in sections of the hand hole embedded members face downwards, inner side surfaces of the hand hole embedded members are integrally welded to the two ends of the fluid-filled steel pipes, and outer side surfaces of the fluid-filled steel pipes are connected to the circumferentially adjacent segment by means of the straight bolts.

* * * * *